US005955404A

United States Patent [19]

Horodysky et al.

[11] Patent Number: 5,955,404

[45] Date of Patent: Sep. 21, 1999

[54] LUBRICANT AND FUEL COMPOSITIONS CONTAINING AN ORGANO-SUBSTITUTED DIPHENYL SULFIDE

[75] Inventors: Andrew G. Horodysky, Cherry Hill; Ross A. Kremer, Lawrenceville, both of N.J.

[73] Assignee: Mobil Oil Corporation, Fairfax, Va.

[21] Appl. No.: 08/968,922

[22] Filed: Nov. 6, 1997

Related U.S. Application Data

[63] Continuation of application No. 08/683,586, Jul. 15, 1996, abandoned, which is a continuation-in-part of application No. 08/407,738, Mar. 20, 1995, abandoned, which is a continuation-in-part of application No. 08/206,232, Mar. 3, 1994, abandoned, which is a continuation of application No. 07/895,478, Jun. 8, 1992, abandoned, which is a continuation-in-part of application No. 07/686,453, Apr. 17, 1991, abandoned.

[51] Int. Cl.[6] ..... C10M 141/10

[52] U.S. Cl. ..... 508/294; 508/376; 508/551; 508/554; 508/569

[58] Field of Search ..... 508/294, 376, 508/551, 554, 569

[56] References Cited

U.S. PATENT DOCUMENTS

| | | | |
|---|---|---|---|
| 3,172,892 | 3/1965 | Le Suer et al. | 260/326.5 |
| 3,194,812 | 7/1965 | Norman et al. | 260/326.5 |
| 3,216,936 | 11/1965 | Le Suer | 252/32.7 |
| 3,272,746 | 9/1966 | Le Suer et al. | 252/47.5 |
| 3,691,220 | 9/1972 | Horodysky | 260/429.9 |
| 3,804,763 | 4/1974 | Meinhardt | 252/51.5 A |
| 4,153,564 | 5/1979 | Chibnik | 252/51.5 A |
| 4,234,435 | 11/1980 | Meinhardt et al. | 252/51.5 A |
| 4,255,271 | 3/1981 | Horodysky et al. | 252/46.7 |
| 4,522,736 | 6/1985 | Andress et al. | 252/51.5 A |
| 4,652,387 | 3/1987 | Andress et al. | 252/49.6 |
| 4,840,744 | 6/1989 | Wallenberg | 252/51.5 A |
| 4,895,579 | 1/1990 | Andres et al. | 44/75 |
| 5,171,915 | 12/1992 | Forbus et al. | 585/455 |

FOREIGN PATENT DOCUMENTS 1093945 12/1967 United Kingdom .

*Primary Examiner*—Jerry D. Johnson
*Attorney, Agent, or Firm*—Malcolm D. Keen

[57] ABSTRACT

Lubricant or fuel compositions comprising 1) an organo, ring-substituted diphenyl sulfide, e.g. a monoalkyldiphenyl sulfide; 2) a dispersant component comprising at least one polymer-substituted succinimide, succinamide and/or succinic acid ester in which the alcohol or phenol moiety of the ester group may optionally contain amide, imide or amine nitrogen functionality, or mixtures of said amide, imide and/or ester; and 3) a dithiophosphate, e.g., a zinc dithiophosphate. The compositions have superior antiwear and extreme pressure properties.

20 Claims, 2 Drawing Sheets

LUBRICANT AND FUEL COMPOSITIONS CONTAINING AN ORGANO-SUBSTITUTED DIPHENYL SULFIDE

CROSS REFERENCE TO RELATED APPLICATIONS

This application is a continuation of application Ser. No. 08/683,586, filed Jul. 15, 1996, now abandoned, which is a continuation-in-part of application Ser. No. 08/407,738, filed Mar. 20, 1995, now abandoned, which is a continuation-in-part of application Ser. No. 08/206,232, filed Mar. 3, 1994, now abandoned, which is a continuation of application Ser. No. 07/895,478, filed Jun. 8, 1992, now abandoned, which is a continuation-in-part of application Ser. No. 07/686,453, filed Apr. 17, 1991, now abandoned.

BACKGROUND OF THE INVENTION

1. Field of the Invention

This invention relates to lubricant and fuel compositions having improved antiwear and extreme pressure properties.

2. Background Information Including Description of Related Art

Alkyldiarylsulfide high temperature lubricants, dithiophosphate (or phosphorodithioate) antiwear agents, and polymer-substituted succinic acid derivative ashless detergents are each known in the art individually as components of lubricant compositions. However, any lubricant or fuel composition containing a combination of these components which has better than expected antiwear, extreme pressure, antioxidant, high temperature stability and other properties is considered very desirable.

The following prior art references are related to the claimed invention.

U.S. Pat. Nos. 3,172,892 issued Mar. 9, 1965 and 3,272,746, issued Sep. 13, 1966 both to Le Suer et al., each discloses polymer-substituted succinamides and succinimides which are useful in lubricant compositions and are prepared by reacting a polymer-substituted succinic acid or succinic anhydride with an alkylene polyamine.

U.S. Pat. No. 3,194,812, issued Jul. 13, 1965 to Norman et al., teaches the use of high molecular alkenyl-n-para-aminophenyl succinimide as a dispersing agent in lubricants.

U.S. Pat. No. 3,216,936, issued Nov. 9, 1965 to Le Suer, disclose lubricant additives which are predominantly amides and imides prepared by reacting an alkylene amine with a polymer-substituted succinic acid or anhydride and an aliphatic hydrocarbon monocarboxylic acid. The compounds are adapted for use with metal phosphorodithioates.

U.S. Pat. No. 3,691,220, issued Sep. 12, 1972 to Horodysky, describes diorganophosphrodithioates prepared from the corresponding acid and a basic zinc compound in the presence of isopropyl alcohol, which are used as additives for lubricating oils.

U.S. Pat. No. 3,804,763, issued Apr. 16, 1974 to Meinhardt, discloses dispersant compositions useful as additives for lubricating oils, prepared by reacting a carboxylic acylating agent having at least 30 carbon atoms, e.g., a polymer-substituted succinic acid, anhydride or ester, with a hydroxy compound, a polyoxyalkylene polyamine, and an alkylene amine.

U.S. Pat. No. 4,153,564, issued May 8, 1979 to Chibnik, teaches compounds that act as emulsifiers, detergents, and antioxidants for lubricating compositions, prepared by reacting an alkenylsuccinic anhydride acid with an aromatic amine-aldehyde resin.

U.S. Pat. No. 4,234,435, issued Nov. 18, 1980 to Meinhardt et al., describes lubricant additives which are prepared by reacting an acylating agent derived from a polyalkene and a dibasic carboxylic such as maleic acid or derivative, with a polyethylene polyamine, and wherein the polyalkene has a number average molecular weight ($M_n$) of about 1300 to 5000 and a ratio of weight average to number average molecular weight ($M_w/M_n$) of about 1.5 to about 4.

U.S. Pat. No. 4,255,271, issued Mar. 10, 1981 to Horodysky et al., shows phosphorodithioate additives for reducing friction and wear when added to a lubricant, prepared by reacting a phosphosulfurized hydrocarbyl oxazoline with a nitrogen containing compound and an olefin.

U.S. Pat. No. 4,522,736, issued Jun. 11, 1985 to Andress et al., discloses products having utility as a dispersant and/or anticorrosion agent when used in a lubricant, which are prepared by reacting a polyalkenylsuccinic compound with an aromatic secondary amine or hindered phenol containing a hydroxyalkyl group, followed by reaction with an alkanolamine or an aminomethane.

U.S. Pat. No. 4,652,387, issued Mar. 24, 1987 to Andress et al., teaches borated reaction products of an alkenyl succinic compound, an aryl amine and an aminoalcohol which are described as highly effective dispersant and antioxidant/anticorrosion additives for lubricant compositions.

U.S. Pat. No. 4,840,744, issued Jun. 20, 1989 to Wollenberg et al., describes polyamino alkenyl or alkyl succinimides containing carbamate functionalities, which are useful as dispersants in lubricating oils.

U.S. Pat. No. 4,895,579, issued Jan. 23, 1990 to Andress et al., discloses products providing dispersant and antioxidant activity to lubricant compositions, which are prepared by reacting an alkenylsuccinic compound with an arylamine and a hindered alcohol.

U.S. Pat. No. 5,171,915, issued Dec. 15, 1992 to Forbus et al., teaches the alkylation of any of a wide variety of aromatic compounds, including diphenylsulfide, using as an alkylating agent a monoolefinic dimer of an olefin obtained as a by-product in the production of high viscosity index poly-alphaolefins (HVI-PAO), and a Friedel-Crafts compound or zeolite as an alkylation catalyst. The alkylated aromatic compounds are useful as lubricant additives imparting antioxidant and antiwear properties.

British Patent No. 1,093,945, published Dec. 6, 1967, discloses alkyldiarylsulfides useful as high temperature functional fluids such as lubricants.

SUMMARY OF THE INVENTION

In accordance with this invention, compositions suitable for use in lubricants and fuels are provided comprising 1) an organo ring-substituted diphenyl sulfide; 2) a dispersant component which is polymer-substituted succinic acid derivative, viz., a polymer-substituted succinimide, succinamide, or succinic acid ester in which the alcohol or phenol moiety of the ester group may optionally contain amide, imide or amine nitrogen functionality, or mixtures of said amide, imide and/or ester; and 3) a dithiophosphate, also known as a phosphorodithioate.

It has been found that lubricant compositions comprising the foregoing three components have unexpectedly good antiwear and extreme pressure properties as well as other desirable properties such as those of corrosion resistance and high temperature cleanliness.

DETAILED DESCRIPTION OF THE INVENTION

Figure 1:
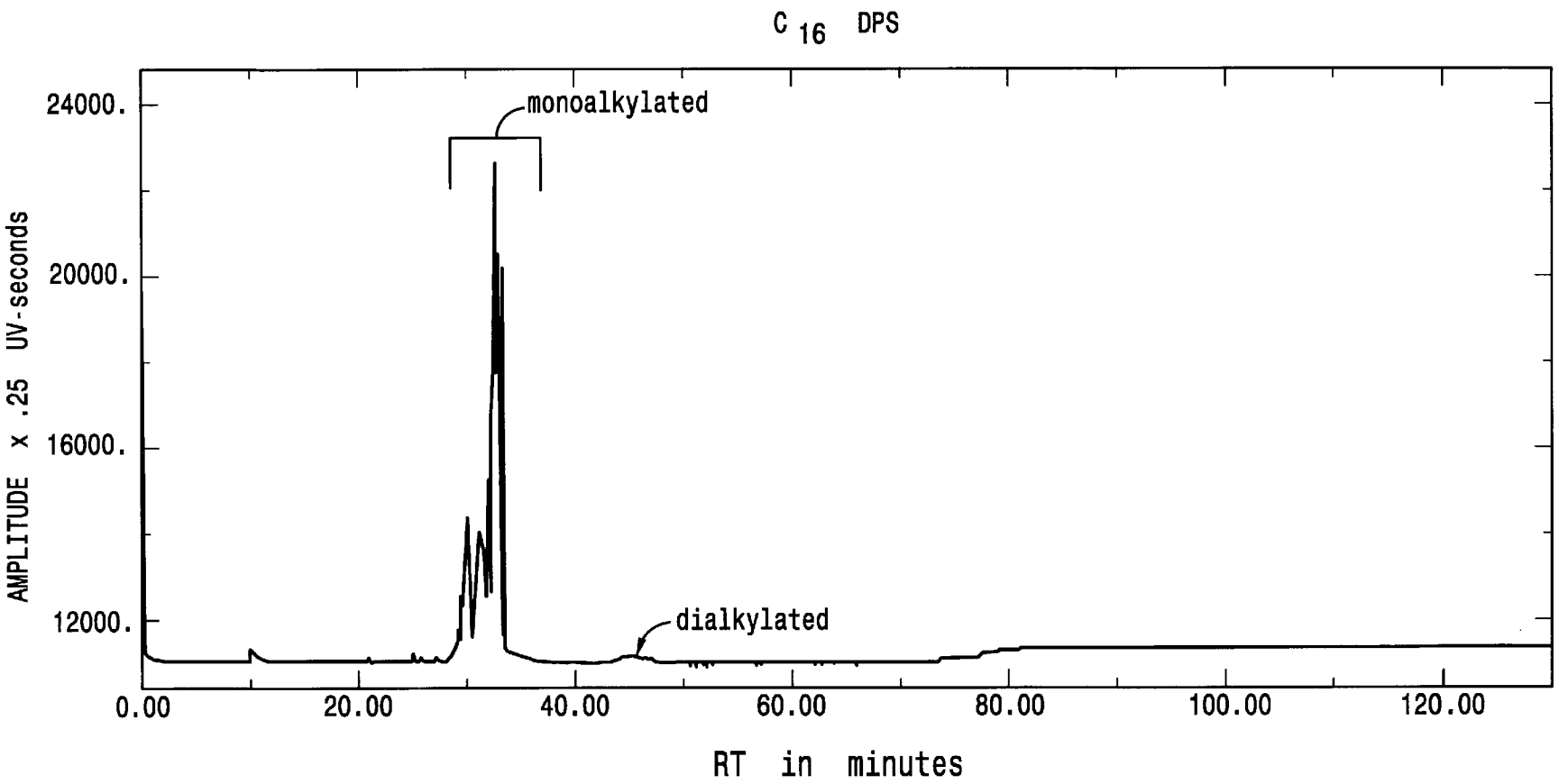
FIGS. 1 and 2 of the drawings are typical gas chromatograph (GC) diagrams of alkylated $C_{16}$ diphenyl sulfide products produced with an acidic zeolite catalyst, which are suitable as a component of the compositions of this invention.

The organo groups in the ring substituted diphenyl sulfide present in the compositions of this invention are substituted for the hydrogen atoms bonded to ring carbon atoms. Such organo groups may be for example alkyl, alkenyl, alkenyl, arylalkyl, alkyaryl, or aryl, in which the aliphatic groups may be cyclic, linear or branched. Moreover, one or more hydrogen and/or carbon atoms in such groups may be substituted with S, N, O, P and/or F. The organo-substituted diphenyl sulfide may contain, for example, 1 to 8, preferably 1 to 2 ring-substituted organo groups, with each substituent organo group containing in the range, for example, of about 1 to 500, preferably about 5 to 50, and most preferably about 10 to 30 carbon atoms. Preferably all the ring-substituted organo groups are selected from the previously delineated hydrocarbon groups, more preferably they are all alkyl groups, even more preferably the organo-substituted diphenyl sulfide is a mono- or dialkylated diphenyl sulfide in which the alkyl group is linear and contains from about 5 to about 40 carbon atoms, and most preferably for certain lubricant and/or fuel uses, the substituted diphenyl sulfide is a monoalkyldiphenyl sulfide wherein the alkyl group contains from about 10 to 20 carbon atoms.

The organo-ring substituted diphenyl sulfide is generally prepared by reacting with diphenyl sulfide in the presence of an alkylation catalyst, an organic substitution reactant having the same structure as the organo group to be substituted except that it contains a preferably terminal double-bonded carbon atom which becomes bonded to a ring carbon atom of the diphenyl sulfide. Thus, to obtain an n-alkyldiphenyl sulfide, the diphenyl sulfide is reacted with an alpha-olefin containing the same number of carbon atoms as the n-alkyl substituent. Mixtures of different organic substitution reactants containing terminal double-bonded carbon atoms as well as mixtures of such reactants containing terminal double-bonded carbon atoms and those containing internal double-bonded carbon atoms may also be used. Generally speaking, the molar ratio of organic substitution reactant to diphenyl sulfide varies from about 0.5:1.0 to about 10.0:1.0 and preferably from about 1.0:1.0 to about 4.0:1.0.

The alkylation catalyst used to prepared the organo-substituted diphenyl sulfide may be, for example, a Friedel-Crafts catalyst such as aluminum trichloride or boron trifluoride. Preferably, however, the reaction is carried out in the presence of a zeolite catalyst, to obtain a substantially mono-substituted diphenyl sulfide. Such zeolite catalyst should be at least partly in the acidic (H) form to confer the acidity for the reaction but may contain other cations also such as ammonium ($NH_4$+), and is preferably a large pore zeolite such as a faujasite, e.g., zeolite X, Y, USY, UHP-Y, ZSM-20 or zeolite beta. Another zeolite which may be used is zeolite MCM-22. Zeolite USY is sold commercially as Octacat cracking catalyst. The reaction is effected at temperatures ranging from ambient to 350° C., preferably from 100–250° C. and most preferably from 180–240° C. over the period required to produce conversion of reactants to desired product. The reaction can be performed, for example, in a batch or semi-batch mode by continuous or partial addition of catalyst or organic substitution reactant to the diphenyl sulfide. Catalyst can be used at levels ranging from 1 gram/mole of aromatic to 100 grams/mole of aromatic, preferably from 5 gram/mole of aromatic to 50 grams/mole of aromatic, and most preferably from 10–30 grams catalyst/mole of aromatic. The catalyst may be steamed, calcined or fresh.

The above preferred method demonstrates the use of the catalysts of choice. MCM-22 is disclosed in U.S. Pat. Nos. 4,954,325; 5,100,534, wherein it is described as a crystalline aluminosilicate zeolite; and 5,103,066. The disclosure of each of these patents is incorporated herein by reference.

FCC (fluid catalytic cracking) catalysts based on ultrastable Y type (USY) zeolites are well known in the art to make gasoline having a higher octane number than FCC catalysts based on rare earth exchanged Y (REY) or calcined rare earth exchanged Y (CREY); see U.S. Pat. No. 5,102,530 which is incorporated herein by reference. It is further disclosed in U.S. publication/notice H 449 of Rudesill that the commercially available FCC cracking catalyst (Octacat) comprises about 40% Ultrastable Type Y zeolite combined with a silica-alumina sol binder and kaolin matrix and that preferably the USY containing Octacat may comprise from about 15 to about 60 wt. % USY and more preferably from about 35 to about 45 wt. % USY. Publication H 449, filed Jul. 3, 1987 and published Mar. 1, 1988 is incorporated herein by reference.

The mono-organo-substituted diphenyl sulfides, e.g., monoalkyldiphenyl sulfides, obtained with the zeolite catalysts, exhibit superior properties in comparison to the organo-substituted diphenyl sulfides prepared by reaction of the organic substitution reactant, e.g. alpha-olefin, with the diphenyl sulfide in the presence of $AlCl_3$ and other proton, and Lewis acids as described in G. A. Olah's "Friedel-Crafts and Related Reactions," Vol. I, 1963, Interscience Publishers.

Figure 2:
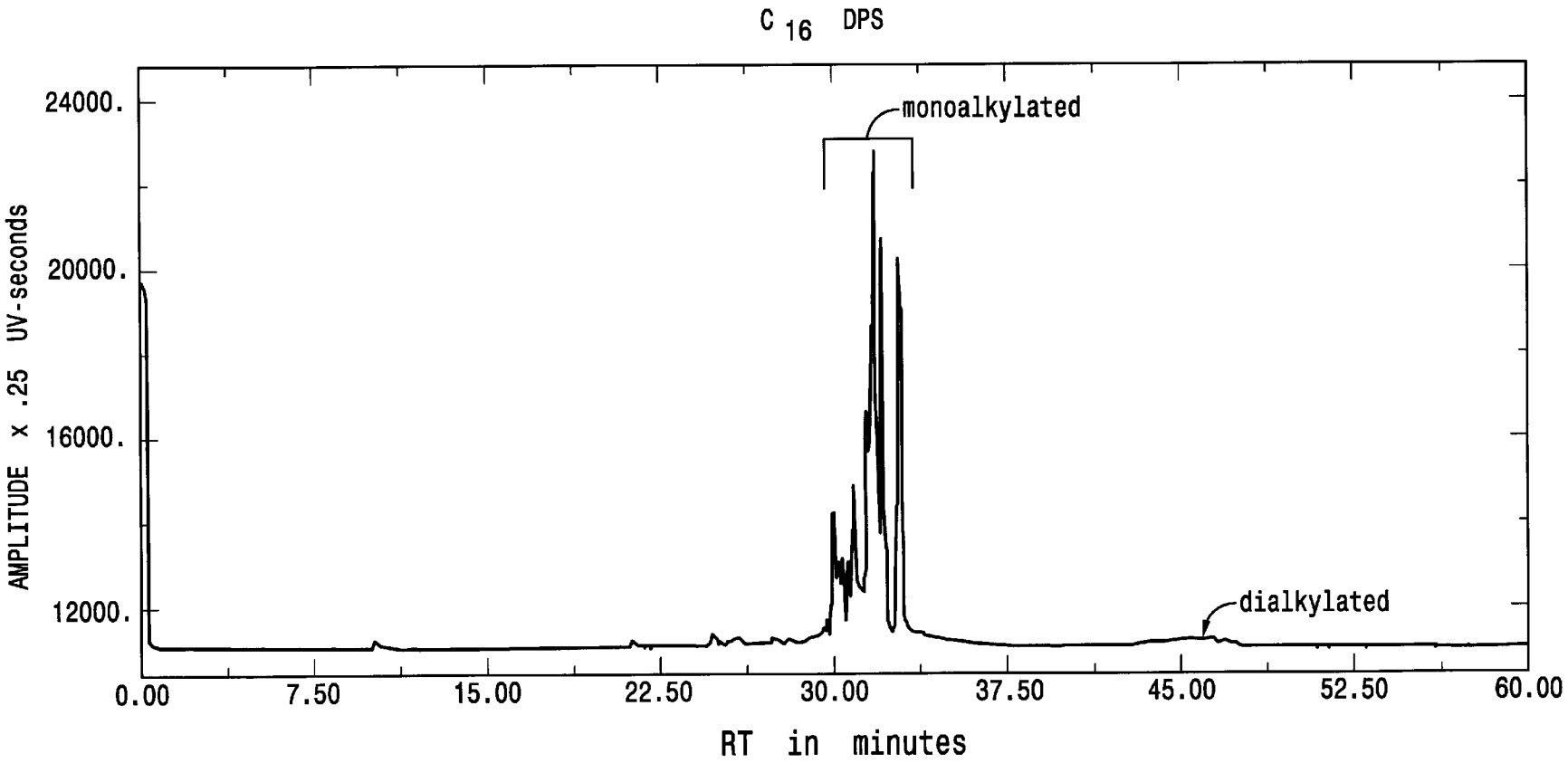

As noted hereinabove, the mono-substituted diphenyl sulfides obtained with zeolite alkylation catalysts are substantially, i.e., up to about 100% and at least about 95–98% mono-substituted, e.g., monoalkylated. FIGS. 1 and 2 which are GC graphs of alkylated $C_{16}$ diphenyl sulfide products produced with FCC Octacat USY catalyst, corroborate this. The irregular base line is due to impurities, the computer temperature program and/or unreacted material (excepting the dialkyated material).

The organo-substituted diphenyl sulfide may be used as the main base stock oil in lubricant or fuel compositions or in combination with other synthetic and/or mineral oil fluids. In either case, it will generally have a viscosity in the range, for example, of about 2 to about 1000 cSt, preferably about 3 to 100 cSt, and more preferably about 3 to 30 cSt, at 100° C., and be present in the composition in the range, for example, of about 0.5 to 95 wt. % or more, preferably about 2 to about 90 wt. %, with concentrations of about 2 to about 20 wt. % being preferred in some applications, particularly when another base stock oil is used with the substituted diphenyl sulfide, and about 25 to about 90 wt. % in the other applications.

The compounds making up the dispersant component of the compositions of this invention, singly or in combination, viz., a polymer substituted succinic acid derivative which is 1) a succinimide; 2) a succinamide; or 3) a succinic acid ester in which the alcohol or phenol moiety of the ester group may optionally contain amide, imide or amine nitrogen functionality, are very complex mixtures of condensation reaction products of the respective succinic acid derivative reactant. Some of the components of the mixture may, for example, have any of the following structures

1)

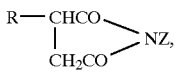

2)

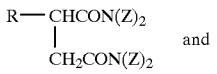

and

3)

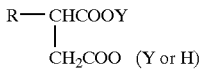

wherein R is the residue of a homopolymer or copolymer of ethylenically unsaturated monomers, e.g., an alkyl or alkenyl group which is the residue of a polyalkene wherein the alkene contains, for example, 2 to 20 carbon atoms, and R has at least 20, preferably at least 50, and up to about 300 or more carbon atoms, and has a number average molecular weight ($M_n$) of, for example, about 300 to 10,000, preferably about 500 to 2,000; Z is (separately in formula 2) hydrogen or an aliphatic or aromatic organic radical containing carbon, hydrogen and optionally nitrogen and/or oxygen and/or is the residue of an amino compound which is reacted with a polymer-substituted succinic acid derivative acylating agent; and Y is an aliphatic or aromatic radical containing carbon, hydrogen, nitrogen and optionally oxygen and/or is the residue of an alcohol containing amide, imide or amine nitrogen functionality, which is reacted with a polymer substituted succinic acid derivative acylating agent.

The dispersant is prepared, for example, by reacting maleic anhydride or acid with a suitable polymer, e.g., of an alkene containing, for example 2 to 20 carbon atoms, which contains a double bond or a halogen atom, e.g., chlorine, to obtain a polymer substituted succinic acid or anhydride acylating agent. The latter is then reacted with an appropriate hydrocarbyl substituted amine, or an alcohol or phenol which may optionally contain amide, imide or amine nitrogen functionality, to obtain the desired dispersant. Some suitable dispersants are polymer-substituted succinamides and succinimides disclosed in U.S. Pat. No. 3,172,892 wherein Z is the residue attached to a reactive nitrogen atom of an ethylene polyamine having the formula

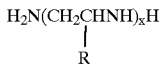

wherein x is an integer, e.g., of 1 to 5, and R is hydrogen or lower alkyl; a polyisobutenyl substituted succinimide as disclosed in U.S. Pat. No. 3,194,812 wherein Z is para-aminophenyl; the polymer-substituted succinamides disclosed in U.S. Pat. No. 3,272,746 wherein Z is any of a wide variety of nitrogen-containing and non-nitrogen containing groups and preferably the residue attached to a reactive nitrogen atom of an alkylene polyamine having the formula

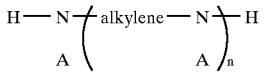

wherein n is an integer preferably less than about 10, A is a hydrogen or hydrocarbon radical, and the alkylene group has less than 8 carbon atoms; polymer-substituted succinamides and succinimides disclosed in U.S. Pat. No. 3,216,936 wherein Z in the imides and at least one Z in the amides is the residue attached to a reactive nitrogen atom of an alkylene polyamine or mixture of alkylene polyamines having the formula

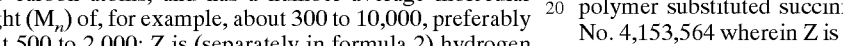

wherein x is an integer preferably less than 6 and the alkylene is a lower alkylene, e.g., containing up to 4 carbon atoms, and cyclic homologs of such amines, e.g., piperazine; mixtures of polymer substituted succinamides, succinimides and succinic acid esters as disclosed in U.S. Pat. No. 3,804,763 wherein Z in the imides and at least one Z in the amides may be the residue attached to a reactive nitrogen atom of any of a wide variety of polyoxyalkylene polyamines and alkylene polyamines, and Y in the ester may be the residue attached to a hydroxy group of any of a wide variety of nitrogen-containing and non-nitrogen containing hydroxy compounds, e.g., monohydric and polyhydric alcohols and phenols, polyalkylene glycols, monoesters of polyhydric compounds, aminoalcohols, aminophenols, etc.; polymer substituted succinimides as disclosed in U.S. Pat. No. 4,153,564 wherein Z is the residue attached to a reactive nitrogen atom of an aromatic amine-aldehyde resin or the latter product reacted with an aromatic triazole and an aldehyde; polymer substituted succinamides and succinimides as disclosed in U.S. Pat. No. 4,234,435 wherein the polymer substituent R is derived from any of a large group of homopolymers and copolymers of a wide variety ethylenically unsaturated monomers, preferably hydrocarbon monomers, which have a number average molecular weight ($M_n$) of about 1300 to about 5000 and a ratio of weight average molecular weight ($M_w$) to $M_n$ of from about 1.5 to about 4, and Z in the imides and at least one Z in the amides is the residue attached to a reactive nitrogen atom of an alkylene polyamine such as those disclosed in several of the other patents cited in this paragraph; polymer-substituted succinamides, succinimides, or succinic acid esters as disclosed in U.S. Pat. No. 4,522,736 wherein in the case of succinamides and succinimides, at least one Z is the residue attached to a reactive nitrogen atom of an aromatic secondary amine subsequently reacted with an alkanolamine or aminomethane, or in the case of succinic acid esters, Y is the residue attached to a hydroxy group of a hindered phenol containing a hydroxy group subsequently reacted an alkanolamine or aminomethane; borated mixtures of polymer-substituted succinamides, succinimides and succinic acid esters as disclosed in U.S. Pat. No. 4,652,387 wherein in the case of the succinamides and succinimides, Z in the imide and at least one Z in the amide is the residue attached to a reactive nitrogen atom of a diarylamine and/or an aminoalcohol and in the case of the succinic acid esters, Y is the residue attached to a hydroxy group of an aminoalcohol; polymer-substituted succinimides as disclosed in U.S. Pat. No. 4,840,744 wherein Z contains carbamate functionalities; and polymer-substituted succinamides and succinimides as disclosed in U.S. Pat. No. 4,895,579 wherein Z in the imides and at least one Z in the amides is the residue attached to a reactive nitrogen atom of an aromatic amine, further reacted with a hindered alcohol. The portions of the disclosures of all the patents cited in this paragraph relating to the chemical structures and methods of preparation of the succinic acid derivatives, all of which are contemplated for use in this invention, are hereby herein by reference.

The polymer substituted succinic acid derived dispersant may be present in the composition in an amount, for example, of about 0.1 to about 25 wt. %, preferably about 0.15 to about 10 wt. %, and most preferably about 1 to about 7 wt. % based on the weight of the composition.

The dithiophosphate component of the compositions of this invention is in most cases derived from an organodithiophosphoric acid having the formula

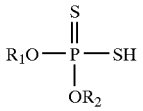

wherein $R_1$ and $R_2$ are separate hydrocarbyl radicals or together form with the phosphorus and oxygen atoms monomeric ring structures or polymeric chain structures. Preferably, the dithiophosphate is a metal salt of a dihydrocarbyl dithiophosphoric acid where the metal is a member of Group II of the Periodic table, particularly zinc and barium and preferably zinc. Ashless dithiophosphates may also be used, e.g., reaction products of an alkylene oxide, an amine or an olefin with an organodithiophosphoric acid as is well-known in the art. In defining the acid with reference to the foregoing formula, the $R_1$ and $R_2$ groups may be the same or different and are selected from the group consisting of alkyl, cycloalkyl, aryl, alkaryl and aralkyl radicals, the radicals having from about 3 to about 30 carbon atoms. Such $R_1$ and $R_2$ groups may be exemplified by n-propyl, isopropyl, n-butyl, iso-butyl, amyl, hexyl, decyl, dodecyl, octadecyl, eicosyl, pentacosyl, benzyl, phenethyl, cyclohexyl, phenyl, naphthyl, tolyl, t-amylphenyl, didodecylphenyl, wax phenyl, where the wax portion contains about 24 carbon atoms, and the like. It is also contemplated that neoalkyl radicals, such as 2,2-dimethyl-1-propyl, 2,2,4-trimethyl-1-butyl, 2,2-dimethyl-1-decyl and 2,2,4-trimethyl-1-hexadecyl, may be used.

Illustrative of the acids which can be used and in which $R_1$ and $R_2$ are the same are the dipropyl, dibutyl, dihexyl, didodecyl, dioctadecyl, dicyclohexyl, dibenzyl, diphenethyl, diphenyl, ditolyl, didodecylphenyl, diwaxphenyl, di(2,2-dimethyl-1-propyl), di(2,2,4-trimethyl-1-butyl), di(2,2-dimethyl-1-decyl) and di(2,2-4-trimethyl-1-hexadecyl) dithiophosphoric acid.

Useful acids wherein $R_1$ and $R_2$ are different are illustrated by the following: n-propyl amyl, amyl decyl, hexyl dodecyl, decyl cyclohexyl, benzyl phenyl and the like dithiophosphoric acids.

Preferably $R_1$ and $R_2$ are alkyl groups containing 1 to 50 carbon atoms, more preferably 3 to 20 carbon atoms.

The foregoing metal dithiophosphates are known in the art as shown for example in U.S. Pat. Nos. 3,216,936 and 3,691,220, the entire disclosures of which relating to the identity, chemical structure, and preparation of these compounds is incorporated herein by reference.

Examples of dithiophosphoric acids wherein $R_1$ and $R_2$ together define a monomeric ring structure or a polymeric chain structure are those containing one or more oxazoline groups as shown in U.S. Pat. No. 4,255,271, the entire disclosure of which relating to the identity, chemical structure and preparation of these compounds is incorporated herein by reference.

The dithiophosphate component may be present in the composition in an amount, for example, about 0.05 to about 10 wt. %, preferably about 0.1 to about 5 wt. %, and most preferably about 0.2 to about 3 wt. % based on the weight of the composition.

The compositions of this invention may be combined or blended with other synthetic oils and/or mineral oils and particularly with synthetic polyalphaolefins (PAO). Any suitable blending ratio of substituted diphenylsulfide to other synthetic oil and/or mineral oil may be used; for example, a base stock blend of 20 wt. % of substituted diphenylsulfide and 80 wt. % PAO has been found to be very advantageous. However, the substituted diphenylsulfide may constitute a major proportion of the base stock oil up to 100%.

In general, mineral oils, both paraffinic, naphthenic and mixtures thereof, employed as part of base stock oil in the lubricant, or grease vehicle, may be of any suitable lubricating viscosity range, as for example, from about 1.0 cst at 100° C. to about 1000 cSt at 100° C. and preferably, from about 2.0 to about 60 cSt at 100° C. The preferred oils may have viscosity indexes ranging to about 150. The average molecular weights of these oils may range from about 250 to about 800.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyalphaolefins, e.g., polyisobutylene, polybutenes, or hydrogenated polydecenes, polypropylene glycol, polyethylene glycol, trimethylpropane esters, nepentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers.

The compositions of the invention may also be used in greases or in any of the foregoing synthetic and/or mineral base stock oils thickened with an appropriate thickener. When the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other aspects, any material which is normally employed for thickening or gelling hydrocarbon fluids for forming greases can be used in preparing greases in accordance with the present invention.

If a mineral oil or synthetic oil base stock oil of lubricating viscosity, in addition to the substituted diphenyl sulfide is utilized in the composition, it may be present in an amount, for example of about 2 to about 98 wt. %, preferably about 5 to about 90 wt. %, based on the total composition.

In addition to the three essential components of the compositions of this invention and an additional synthetic or mineral base stock oil, if used, various combinations of other components commonly used in lubricants and other functional fluids may also be included, e.g., additional dispersants, metallic detergents (phenates, sulfonates, and/or salicylates), antioxidants (as exemplified by hindered phenols, arylamines, dithiocarbamates, etc.), polymeric viscosity index improvers (polyisobutylene, styrene-diene copolymers, polymethacrylates, etc.), auxiliary antiwear or extreme pressure additives (heterocyclic triazoles, dimercaptothiadiazoles, dithiocarbamates, phosphites, phosphonates, acid phosphates, thiophosphates, phosphonothionates, borates, etc.), corrosion inhibitors, emulsifiers, demulsifiers, seal swell agents, antistain additives, and the like.

When formulated as a lubricant, the composition of this invention can be used in demanding applications such as diesel engine oils which generate large quantities of performance-property robbing particulate soot, or in somewhat less demanding applications such as turbine, circulating, or hydraulic oils, or in thickened lubricants such as greases.

Although the preferred use of the composition of this invention may reside in lubricant applications, use in fuels would also provide many of the same performance advantages. Concentrations of 1 to 1,000 pounds of components per thousand barrels of fuel are preferred. Fuel compositions include hydrocarbon fuels, oxygenated fuels, and mixtures of hydrocarbon and oxygenated fuels. Use of a mixture of aromatic fluid and dispersant would be especially advantageous in fuels.

The following examples further illustrate the invention.

COMPARATIVE EXAMPLES A TO G

The examples illustrate the effect on lubrication properties of mixing a typical lubricating mineral oil with varying amounts of an organo-substituted diphenyl sulfide.

To a vigorously stirred mixture of diphenyl sulfide (186.2 g, 1.0 mile) and 1-hexadecene (224.4 g, 1.0 mole) in a flask fitted with thermocouple and reflux condenser was added 19.1 g of FCC Octacat USY catalyst. The mixture was heated to 200° C. with stirring for six hours. After cooling to room temperature, the mixture was filtered to remove catalyst and vacuum distilled t 170° C. at 0.5–1.5 mmHg to remove unreacted starting materials.

The foregoing substantially monoalkylated diphenyl sulfide (ADPS) was blended in varying amounts with a Stock 318 paraffinic neutral lubricating base stock mineral oil having a viscosity of 100 Saybolt seconds at 40° C. and the blends, together with the pure ADPS and mineral oil were tested for their lubrication properties, using the Four Ball Wear Test described in test method ASTM D2266 and/or U.S. Pat. No. 4,761,482.

In the Four Ball Test three stationary balls are placed in a lubricant cup together with a lubricant containing the compound to be tested, and a fourth ball is placed in a chuck mounted on a device which can be used to spin the ball at known speeds and loads. The examples were tested using half inch stainless steel balls of 5200 steel for 30 minutes under 40 kg load at 1800 rpm and 93° C. Results are shown in Table I in terms of wear scar diameter and "K" factor which is a function of wear volumes and is a dimensionless number defined as the product of the wear volume times the metal hardness divided by the product of the distance travelled and the load. The "K" factor is relatively independent of test conditions, provided effective lubrication is maintained. The "K" factor allows for Hertzian diameter and permits calculations of wear rates that can be related to machine life under various operating conditions and metallurgy.

TABLE I

| Example | ADPS, Wt. % | Wear Scar Diameter, mm | Wear, K Factor |
|---|---|---|---|
| A | 0 | 1.62 | 372 |
| B | 1 | 1.87 | 662 |
| C | 2 | 1.53 | 300 |
| D | 5 | 1.57 | 327 |
| E | 25 | 1.29 | 149 |
| F | 50 | 1.38 | 195 |
| G | 100 | 0.7 | 13 |

As shown by the results of Table 1, little improvement in wear response was exhibited using 1, 2, and 5% alkylated diphenyl sulfide blended into a typical paraffinic neutral lubricating mineral oil in the absence of any other added components.

EXAMPLES 1 AND 2 AND COMPARATIVE EXAMPLES H TO L

These examples illustrate the effect on lubrication properties of the mineral oil described in Comparative Examples A to G blended with additive amounts of the ADPS described in said comparative examples, a polyisobutylene succinimide dispersant, and/or a mixed alcohol derived zinc dithiophosphate (ZnDTP). The polyisobutylene succinimide dispersant was prepared as described in previously cited U.S. Pat. No. 4,234,435 and wherein the radical "R" in previously given formula 1) for the component is the residue of a polyisobutylene having a molecular weight as defined in the latter patent and the radical "Z" in such formula is the residue of a polyethylene polyamine as defined in such patent, and the zinc dithiophosphate is the zinc salt of a dithiophosphoric acid where $R_1$ and $R_2$ in previously given formula 4) for these compounds is a mixture of $C_3$–$C_8$ alkyl groups. The compositions were subjected to the Four Ball Wear Test as described in Comparative Examples A to G and the makeup of the compositions and the results of the tests are shown in Table II.

TABLE II

| Example | ADPS, Wt. % | ZnDTP, Wt. % | Dispersant Wt. % | Wear Scar Diameter, mm | Average (3 Runs) Wear Scar Diameter, mm | Wear, K Factor x 10E-8 | Average (3 Runs) Wear, K Factor x 10E-8 |
|---|---|---|---|---|---|---|---|
| H | 0 | 0 | 9 | 1.57 | | 332 | |
| | | | | 1.67 | 1.61 | 420 | 363 |
| | | | | 1.58 | | 337 | |
| I | 0 | 0.05 | 0 | 1.63 | | 382 | |
| | | | | 1.54 | 1.61 | 305 | 367 |
| | | | | 1.66 | | 414 | |
| J | 0 | 0.05 | 9 | 1.56 | | 323 | |

TABLE II-continued

| Example | ADPS, Wt. % | ZnDTP, Wt. % | Dispersant Wt. % | Wear Scar Diameter, mm | Average (3 Runs) Wear Scar Diameter, mm | Wear, K Factor x 10E-8 | Average (3 Runs) Wear, K Factor x 10E-8 |
|---|---|---|---|---|---|---|---|
| | | | | 0.55 | 1.2 | 4 | 201 |
| | | | | 1.5 | | 275 | |
| 1 | 10 | 0.05 | 9 | 0.57 | | 5 | |
| | | | | 1.23 | 0.79 | 125 | 45 |
| | | | | 0.57 | | 5 | |
| 2 | 25 | 0.05 | 9 | 0.55 | | 4 | |
| | | | | 0.58 | 0.78 | 5 | 41 |
| | | | | 1.21 | | 116 | |
| K | 10 | 0.05 | 0 | 0.93 | | 39 | |
| | | | | 1.52 | 1.33 | 292 | 218 |
| | | | | 1.56 | | 323 | |
| L | 25 | 0.05 | 0 | 0.71 | | 13 | |
| | | | | 1.29 | 1.11 | 149 | 114 |
| | | | | 1.35 | | 180 | |

The results of Table II indicate that the addition of substituted diphenyl sulfide in concentrations of 10 and 25% to mineral oil in the presence of dispersant and dithiophosphate (Examples 1 and 2) improves the wear characteristics. In contrast, significantly less improvement was obtained by the use of 10 and 25% substituted diphenyl sulfide in the presence of 0.05% dithiophosphate but in the absence of any polymeric dispersant (Examples K and L).

EXAMPLES 3 AND 4 AND COMPARATIVE EXAMPLES M AND N

These examples illustrate the effect on lubricating properties of adding an organo-substituted diphenyl sulfide to partially spent mineral oil-based lubricants containing a polymer-substituted succinimide ashless dispersant and a dithiophosphate.

A fully formulated commercially obtained diesel engine oil derived from mineral oil base stocks and containing both polymer-substituted succinimide ashless dispersant and zinc dithiophosphate was run in a GM 6.2 liter diesel engine for 50 hours at 1,000 rpm with coolant and oil gallery temperatures of 120° C., a fuel flow of 9 kg/hr, and fuel and inlet air temperatures of 35° C. and 32° C., respectively. The absolute intake air and exhaust back pressures were 97 kPa and 10-3 kPa, respectively. During this time period, the wear properties of the oil significantly diminished, due in part to the combustion by-products (soot) and aging of the lubricant. This oil containing (partially) depleted dispersant and zinc dithiophosphate, was evaluated for wear protection, using the procedure of the preceding examples, in two separate determinations (Examples Ma and Mb). The ADPS utilized in the preceding examples in an amount of 5 wt. % was then added to the depleted oil and two separate wear evaluations were again performed (Examples 3a and 3b). The results are shown in Table III which, in addition to Wear Scar Diameter and K Factor, includes values for Wear Ratio, defined as the Wear Scar Diameter/Hertz Diameter. For a 40 kg load, the estimated mean Hertz diameter=0.30 (mm).

TABLE III

| Example | Alkylated Diphenyl Sulfide, Wt. % | Wear Scar Diameter, mm | Wear K Factor | Wear Ratio |
|---|---|---|---|---|
| Ma | 0 | 1.36 | 182 | 4.53 |
| Mb | 0 | 1.42 | 218 | 4.73 |

TABLE III-continued

| Example | Alkylated Diphenyl Sulfide, Wt. % | Wear Scar Diameter, mm | Wear K Factor | Wear Ratio |
|---|---|---|---|---|
| 3a | 5 | 0.90 | 34.6 | 3.00 |
| 3b | 5 | 0.89 | 33.7 | 2.96 |

The procedure of Example 3 and Comparative Example M was repeated on a different commercially obtained mineral oil based diesel engine oil also containing a polymer-substituted succinimide dispersant and zinc dithiophosphate, except that only a single wear evaluation was obtained for the partially depleted oil containing no ADPS (Comparative Example N) and that containing 5 wt. ADPS (Example 4). The results are shown in Table IV.

TABLE IV

| Example | Alkylated Diphenyl Sulfide, Wt. % | Wear Scar Diameter, mm | Wear K Factor | Wear Ratio |
|---|---|---|---|---|
| N | 0 | 1.31 | 160 | 4.37 |
| 4 | 5 | 0.84 | 26 | 2.80 |

As can be clearly observed from the data in Tables III and IV, the presence of substituted diphenyl sulfide in the oil containing both ashless dispersant and dithiophosphate significantly reduced the wear damage in 4-Ball Wear testing, as measured by the Wear Scar diameters, or resulting "K" Factors and Wear Ratios. The Wear Volumes ("K" Factors) were found to be reduced to ⅙ of their corresponding value when compared to the identical oils without the substituted diphenyl sulfide.

We claim:

1. A lubricant composition comprising 1) about 2 to about 90 wt. % of a substantially monoalkyl ring-substituted diphenyl sulfide in which the alkyl group contains about 5 to 40 carbon atoms; 2) about 1 to about 7 wt. % of a dispersant component comprising a polymer-substituted succinimide, succinamide, and/or succinic acid ester, and 3) about 0.1 to about 3 . wt. % of a dithiophosphate.

2. The composition of claim 1 wherein the alcohol or phenol moiety of the ester group of said succinic acid ester contains amide, amide or amine nitrogen functionality.

3. The composition of claim 1 wherein said dispersant component is prepared by reacting maleic anhydride or acid with a polymer of an alkene, said polymer containing a double bond or halogen atom to obtain a polymer substituted succinic acid or anhydride, and reacting the latter compound with a hydrocarbyl substituted amine, or an alcohol or phenol which may optionally contain amide, imide or amine nitrogen functionality.

4. The composition of claim 3 wherein said polymer of an alkene is a polyalkene containing at least 20 carbon atoms, said alkene containing 2 to 20 carbon atoms, and said polymer substituted succinic acid or anhydride is reacted with an amine compound in which two non-reacting moieties bonded to the amine nitrogen atom are hydrogen or an aliphatic or aromatic radical containing carbon, hydrogen and optionally nitrogen and/or oxygen.

5. The composition of claim 4 wherein said amino compound is an alkylene polyamine having the formula

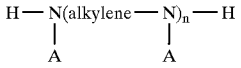

wherein n is an integer less than 10, A is a hydrogen or hydrocarbon radical, and the alkylene group has less than 8 carbon atoms.

6. The composition of claim 1 wherein said organo-substituted diphenyl sulfide is a substantially monoalkyldiphenyl sulfide in which the alkyl group contains 10 to 20 carbon atoms.

7. The composition of claim 6 wherein said mononalkyldiphenyl sulfide is a mono-n-alkyldiphenyl sulfide prepared by alkylating diphenyl sulfide with an alpha-olefin containing the same number of carbon atoms as the n-alkyl groups substituted on the diphenyl sulfide, in the presence of a partially acidic zeolite catalyst, the molar ratio of said alpha-olefin to diphenyl sulfide being from about 0.5:1.0 to about 10.0:1.0, the temperature of alkylation being from ambient to 350° C., and the amount of catalyst being from 1 gram/mole to 100 grams/mole of diphenyl sulfide.

8. The composition of claim 7 wherein said zeolite catalyst is zeolite X, Y, USY, UHP-Y, ZSM-20, beta or MCM-22.

9. The composition of claim 1 wherein said dispersant is a succinimide comprising at least one compound having the formula

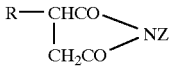

1)

and/or a succinamide comprising at least one compound having the formula

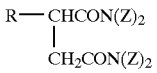

2)

wherein R is an alkyl or alkenyl group which is the residue of a polyalkene wherein the alkene contains 2 to 20 carbon atoms and R has at least 20 carbon atoms; and Z in formula 1) and separately in formula 2) is hydrogen or an aliphatic or aromatic organic radical containing carbon, hydrogen and optionally nitrogen and/or oxygen, and/ or is the residue attached to a reactive nitrogen atom of an amino compound which is reacted with a polymer-substituted succinic acid acylating agent.

10. The composition of claim 9, wherein Z in formula 1) and/or at least one Z in formula 2) is the residue attached to an active nitrogen atom of an alkylene polyamine having the formula

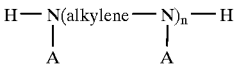

wherein n is an integer less than 10, A is a hydrogen or hydrocarbon radical, and the alkylene group has less than 8 carbon atoms.

11. The composition of claim 1 wherein said dithiophosphate is a zinc salt of dithiophosphoric acid having the formula

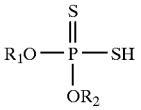

wherein $R_1$ and $R_2$ are separately alkyl groups containing about 3 to 30 carbon atoms.

12. The composition of claim 1 also comprising a mineral oil, synthetic oil, or a mixture of mineral and synthetic oil, of lubricating viscosity.

13. The composition of claim 12 wherein said mineral oil, synthetic oil or said mixture is present in an amount of from about 2 to about 98 wt. %.

14. The composition of claim 13 wherein said mineral oil, synthetic oil, or said mixture is present in an amount of about 5 to about 90 wt. %.

15. The composition of claim 12 comprising a mineral oil.

16. The composition of claim 12 comprising a synthetic oil.

17. The composition of claim 16 wherein said synthetic oil is a hydrocarbon oil.

18. The composition of claim 17 wherein said hydrocarbon oil is a polyalpha-olefin.

19. The composition of claim 12 comprising a mixture of mineral and synthetic oil.

20. The composition of claim 12 wherein said mineral oil, synthetic oil or mixture of mineral oil and synthetic oil is in the form of a grease.

* * * * *